US006227528B1

(12) United States Patent
Billings

(10) Patent No.: US 6,227,528 B1
(45) Date of Patent: May 8, 2001

(54) CLAMPING/SHAPING DEVICE

(75) Inventor: Peter Rodney Billings, Glass House Mountains (AU)

(73) Assignee: Donna Maree Billings, Queensland (AU)

( * ) Notice: Subject to any disclaimer, the term of this patent is extended or adjusted under 35 U.S.C. 154(b) by 0 days.

(21) Appl. No.: 09/380,251

(22) PCT Filed: Feb. 26, 1998

(86) PCT No.: PCT/AU98/00118

§ 371 Date: Aug. 26, 1999

§ 102(e) Date: Aug. 26, 1999

(87) PCT Pub. No.: WO98/38008

PCT Pub. Date: Sep. 3, 1998

(30) Foreign Application Priority Data

Mar. 26, 1999 (AU) ..... P05298

(51) Int. Cl.[7] ..... B25B 1/02
(52) U.S. Cl. ..... 269/182
(58) Field of Search ..... 269/181, 182, 269/183, 173, 174

(56) References Cited

U.S. PATENT DOCUMENTS 2,461,687 2/1949 Hopfeld .
2,881,645 * 4/1959 Kruchten ..... 269/182
3,520,527 * 7/1970 Persson ..... 269/182
3,599,960 8/1971 Phillips .

FOREIGN PATENT DOCUMENTS 201318 8/1923 (GB) .

* cited by examiner

*Primary Examiner*—Robert C. Watson
(74) *Attorney, Agent, or Firm*—Young & Thompson

(57) ABSTRACT

An adjustable clamping device is provided for clamping/shaping work pieces of various dimensions and may be applied for straightening beams, joist, bearers, etc., squaring house frames, positioning form work, or maintaining work pieces in position. The device includes a first clamping member, a second clamping member and an elongate threaded member on which the first and second members are located and arranged for continuous adjustment of relative positions therealong. The second member is fixedly or adjustably located on the elongate member. The first member has cooperating thread engagement arrangement movable between a released position at which the first member is slidingly positional along the elongate member and an engaged position at which the second member cannot slide along the elongate member but is positional by rotating the engagement arrangement in meshing engagement with the elongate member. The device also includes a lever member for moving the engagement means and a biasing part for biasing the engagement arrangement to the engaged position and a maintaining part for maintaining the engagement arrangement at the engaged position, the maintaining part being in the form of a lock nut member or a cam member.

11 Claims, 9 Drawing Sheets

CLAMPING/SHAPING DEVICE

TECHNICAL FIELD OF THE INVENTION

THIS INVENTION relates to a device which is adjustable for clamping/shaping one or more work pieces of various dimensions but in particular and not limited the device has a first clamping/shaping member and a second clamping/shaping secured member which are movable along a threaded elongate member and the first clamping/shaping member including an engagement means for engaging the threaded elongate member.

BACKGROUND ART

Clamping devices have been in use for many years. The existing clamping devices generally have a substantially C-shaped body. One end of the C-shaped body functions as a fixed clamping jaw and the other end of the body has a threaded opening. A threaded spindle with a clamping jaw is arranged in the threaded member so that a work piece can be inserted between the two jaws and the spindle is turned in to clamp the work piece.

Each of the existing clamping devices has a maximum opening between the clamping jaws. Accordingly they cannot be used for clamping work pieces with a dimension larger than the maximum opening.

These clamping devices are also relatively slow to get to a clamping position especially for small work pieces as the spindles must be wound for many times in order to position the clamping jaw on the spindle at said clamping position.

The existing clamping devices cannot be adapted for use with work pieces with dimensions larger than the fixed maximum opening. Accordingly people must purchase clamping devices of different sizes for work pieces of different dimensions.

The existing clamping devices cannot be used in situations where obstacles are between the clamping jaws.

Building frames are sometimes out of square and brute force must be used to square the frames. This process is also time and labour intensive as at least two building works must go to opposite corners of the frames to check whether the frames are square. This process may be repeated a number of times until the frames are square.

Timbers such as floor boards may be bowed and are normally discarded by builders as they cannot be straightened easily.

OBJECT OF THE INVENTION

It is an object of the present invention to alleviate or to reduce to a certain degree one or more of the above prior disadvantages.

Other objects of the present invention will become apparent in the following description of the invention.

OUTLINE OF THE INVENTION

In one aspect the present invention resides in a device for clamping/shaping one or more work pieces. The device compares a threaded elongate member having opposite ends, a first clamping/shaping member located on the elongate member and a second clamping/shaping member also located on the elongate member for clamping or shaping said one or more work pieces between the opposite ends. The first member is arranged so that its position relative to the second member is continuously variable. The first member includes a thread engagement means movable between an engaged position for cooperatively engaging the elongate member and a released position for releasing from said engaged position. At said released position the first member is slidable along the elongate member for positioning it to or away from one or more work pieces and at said engaged position the engagement means prevents sliding movement of the first clamping/shaping member and the engagement means is rotatable about the elongate member for continuously varying the position of the first member relative to the second member.

It is preferred that each of the first and second members have a clamping/shaping plate for contacting the one or more work pieces. Desirably at least the clamping/shaping plate of the first member is rotatable or swivelable independent of the engagement means so that it does not rotate or swivel which the engagement means is in rotation.

It is also preferred that the first clamping/shaping member includes a hollow tube and the clamping/shaping plate is positioned at or adjacent to one end of the tube. The plate has an opening in substantial alignment with the tube and, in use, the elongate member extends within the tube and the opening.

Conveniently the first clamping/shaping member is fixed to a sleeve which is rotatably arranged about the tube at or adjacent the one end of the tube. Limiting means may advantageously be provided on the tube for limiting axial movement of the first clamping/shaping member or the sleeve along the tube.

Typically the limiting means has a ring fixed to said one end of the tube for preventing the first clamping/shaping member from moving out of the tube. A further ring spaced from said ring may also be fixed on the tube so that the first clamping/shaping member is retained within the space between the two rings.

Hand grip means can be provided at or adjacent to the other end of the tube for gripping when rotating or moving the first clamping/shaping member. The tube may also include a turning member to which a hand tool can be applied for rotating this first clamping/shaping member.

The tube may have an aperture through which the engagement means can move between the engaged position and the released position. A lever may be provided for moving the engagement means between the engaged position and the released position.

It is preferred that the engagement means has a toothed section arranged for threadably engaging the threaded elongate member.

The toothed section is adapted to move into the aperture to the engaged position and out of the aperture to the released position.

In one form of the present invention the engagement means is biased to the engaged position. In an alternate form of the present invention the engagement means is biased to the released position. A spring can be used for biasing the engagement means.

Position maintaining means can be arranged for selectively maintaining the engagement means in the engaged position or the released position.

The position maintain means may include a first part which is fixed to the engagement means and a second part fixed to the tube. The first part is movable relative to the second part between the engaged position and the released position. A locking member is advantageously provided for locking the first part in said engaged position. The locking member may be in form of a locking nut or a cam body.

The second clamping/shaping member may be the same or similar to the first clamping/shaping member. Typically, however, the second clamping/shaping member has a clamping/shaping plate fixed to a sleeve and is arranged as described earlier. But in this case the sleeve is threaded or fixed to a threaded member so that the second clamping/shaping member is rotatably movable along the elongate member.

The device of the present invention may be extended by joining two or more threaded elongate members. Joining means in the form of an internal threaded member may be used to join adjacent elongate members.

The elongate member(s) can be in the form of a cyclone rod(s) of any diameter, but typically 12 mm.

The clamping/shaping plates may be of any shape such as circular, rectangular or other polygonal shape.

The device of the present invention can be used for clamping one or more work pieces such as for laminating timber together for a table top, for straightening beams, joints, rafters, bearers, wall studs and floor boards and the like.

The device can also be adapted as a vice on a work bench.

BRIEF DESCRIPTION OF THE EMBODIMENT OF THE INVENTION

In order that the present invention can be readily understood and put into practical effect the description will now be made in reference to the accompanying drawings which illustrate non-limiting embodiments of the present invention, and wherein.

Figure 1:
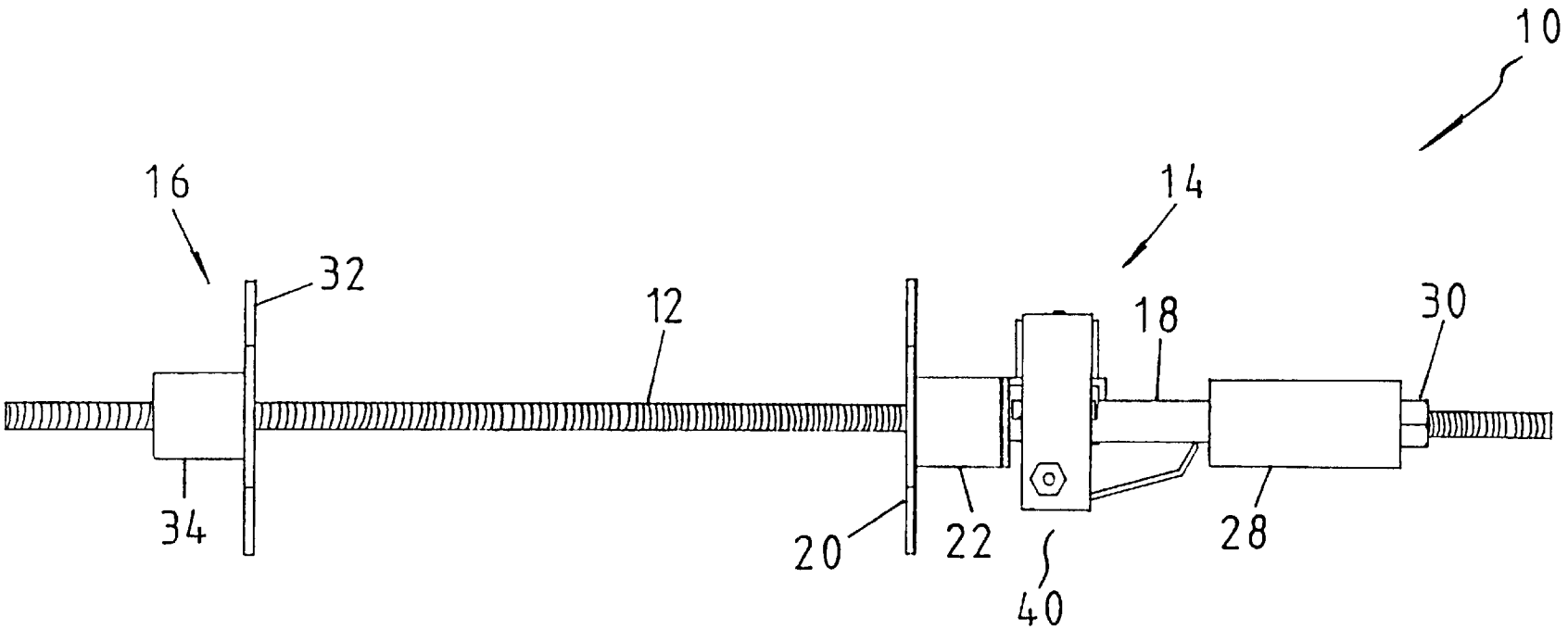
FIG. 1 is a plan view of an embodiment of the device for clamping/shaping according to the present invention.
Figure 12:
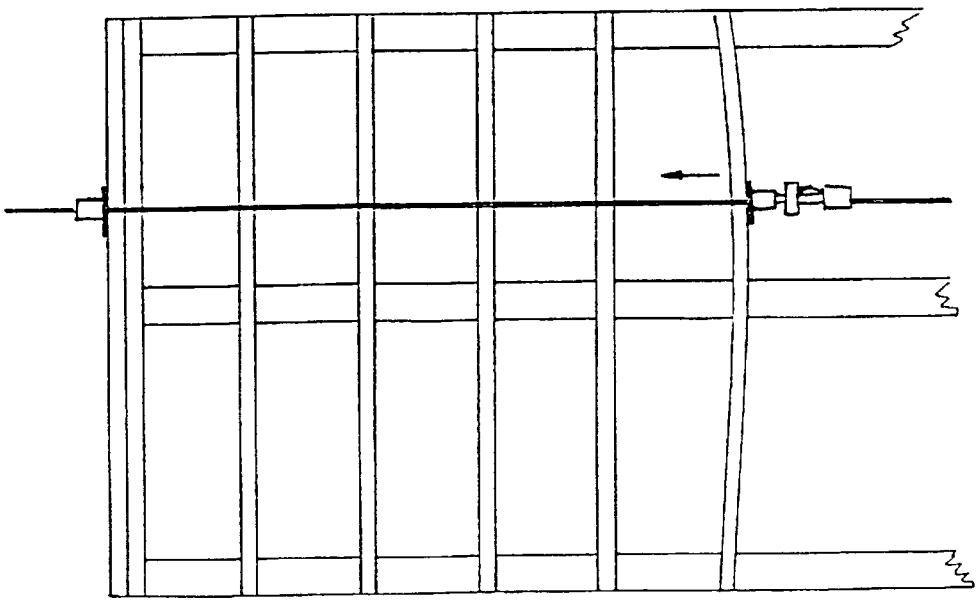
Figure 13:
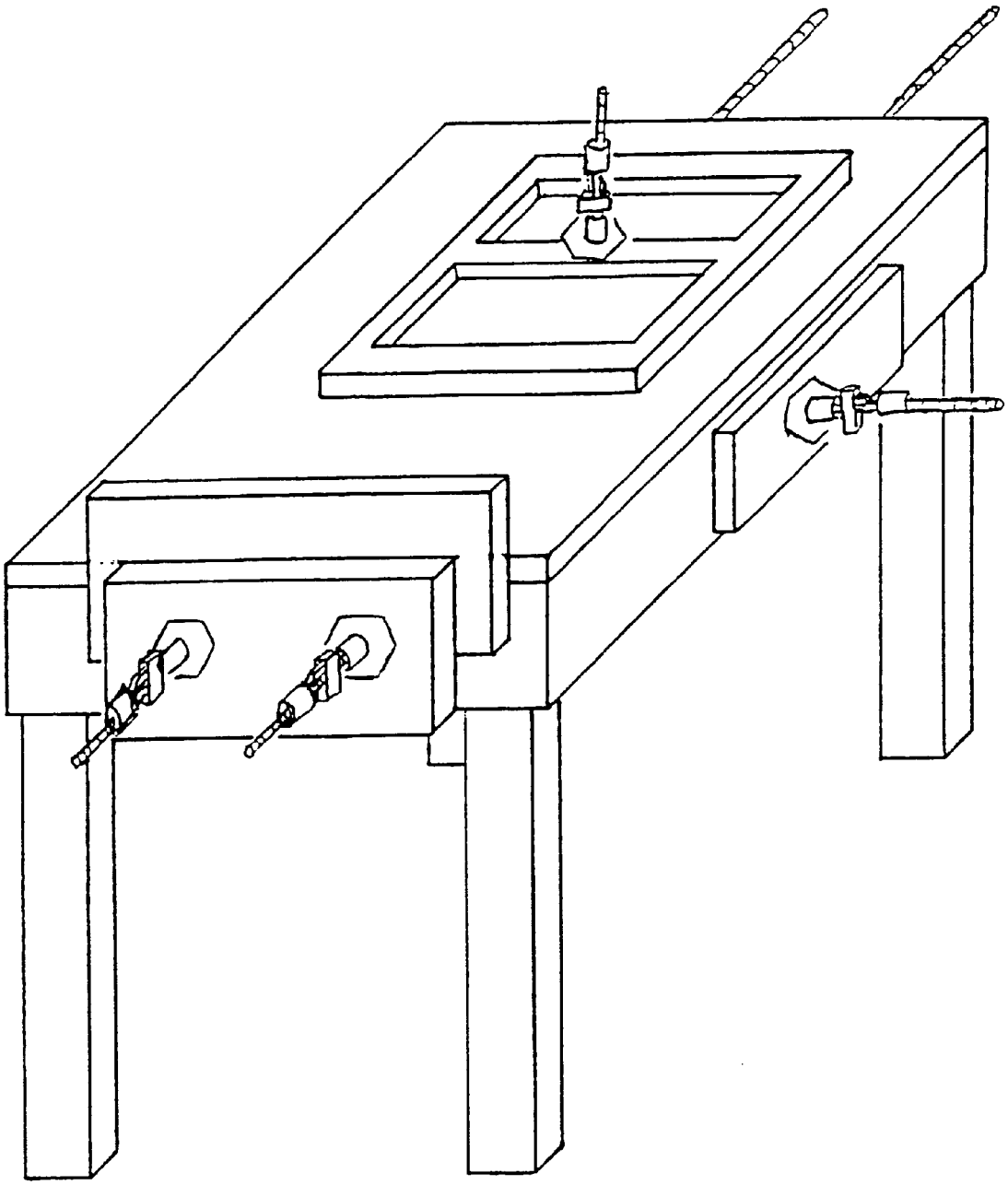

FIG. 12 an application of the device shown in FIG. 1 for straightening floor joist timber; and FIG. 13 shows adaptation of the device shown in FIG. 1 as a vice.

DETAILED DESCRIPTION OF THE EMBODIMENTS OF THE INVENTION

Referring initially to FIG. 1 there is shown a clamping/shaping device 10 according to the present invention. The device 10 comprises a threaded elongate rod 12 which in this case is a 12 mm cyclone rod, a first clamping/shaping member 14 arranged on the rod 12 and a second clamping/shaping member 16 also arranged on the rod 12. The members 14 and 16 are in facing relationship.

As can be seen in details in FIGS. 2 to 8 the first member 14 has a tubular member 18 with an internal diameter slightly larger than the diameter of the rod 12 so that the member 14 can slide along the rod 12. A clamping/shaping plate 20 for clamping/shaping a work piece is rotatably arranged at an end of the tubular member 18. The plate 20 is fixed to a sleeve member 22 which is fitted on the tubular member 18. The internal diameter of the sleeve-member 22 is such that it can rotate about the tubular member 18 spaced ring members 24, 26 are fixed on the tubular member 18 for retaining the plate 20 and the sleeve member 22 in position on the tubular member 18.

A gripping means 28 in the form of a handle is provided at the other end of the tubular member 18 to facilitate moving the member 14.

A nut member 30 is also fixed to said other end of the tubular member so that a hand tool such as a wrench can be fitted on the nut member 30 for turning the member 14. The second member 16 also has a clamping/shaping plate 32 fixed to a sleeve member 34 which is internally threaded.

Turning back to FIG. 1, the clamping/shaping member 14 is locked in that position as shown because its engagement means 40 (to be described in reference to FIGS. 2 and 3) is placed in an engaged position. Tension applied to a work piece (not shown) between the members 14 and 16 can be continuously adjusted by rotating the member 14.

Figure 2:
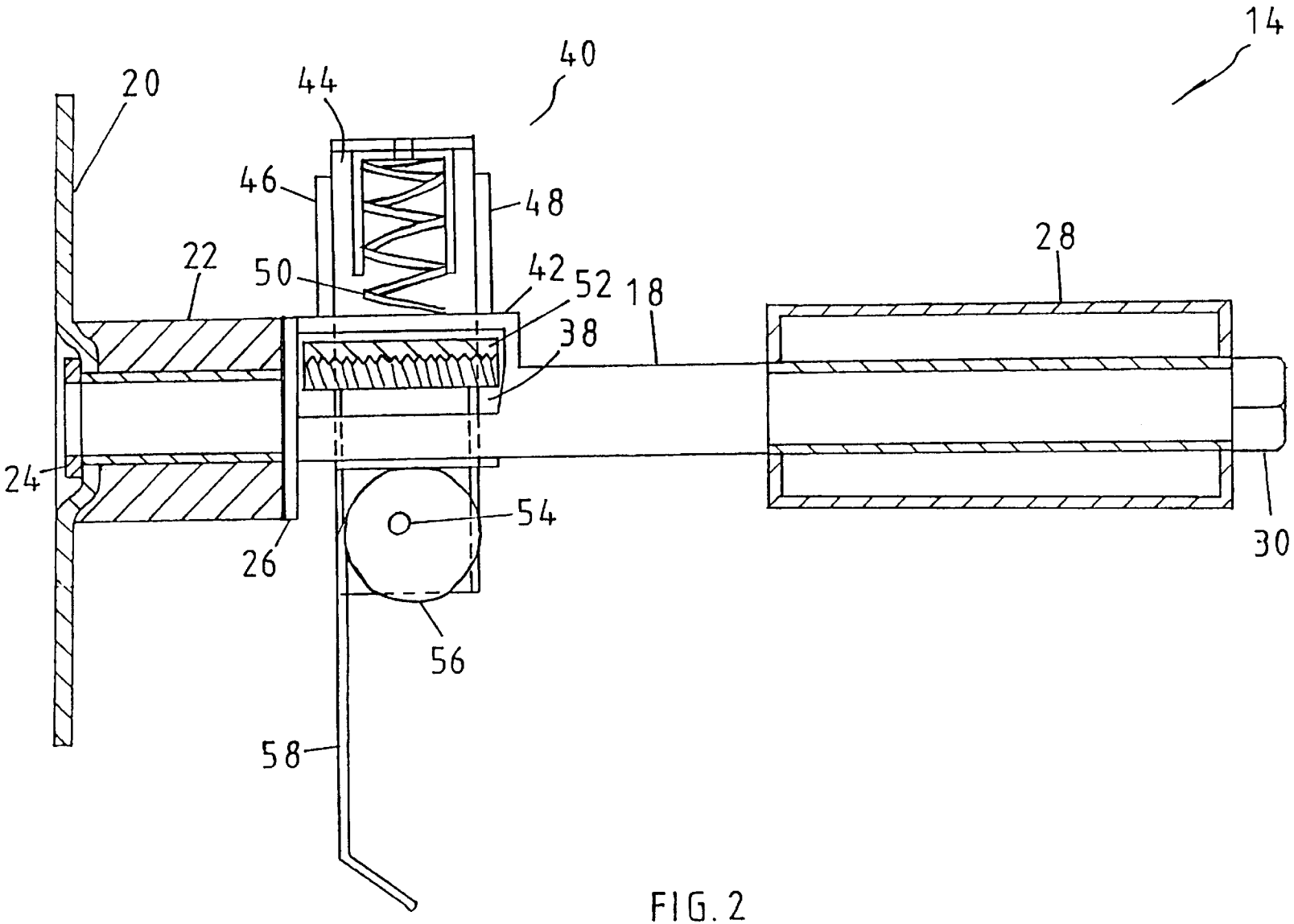
FIG. 2 is a cross-sectional view of the first clamping/shaping member of the device shown in FIG. 1 with the engagement means in a released position.
Figure 3:
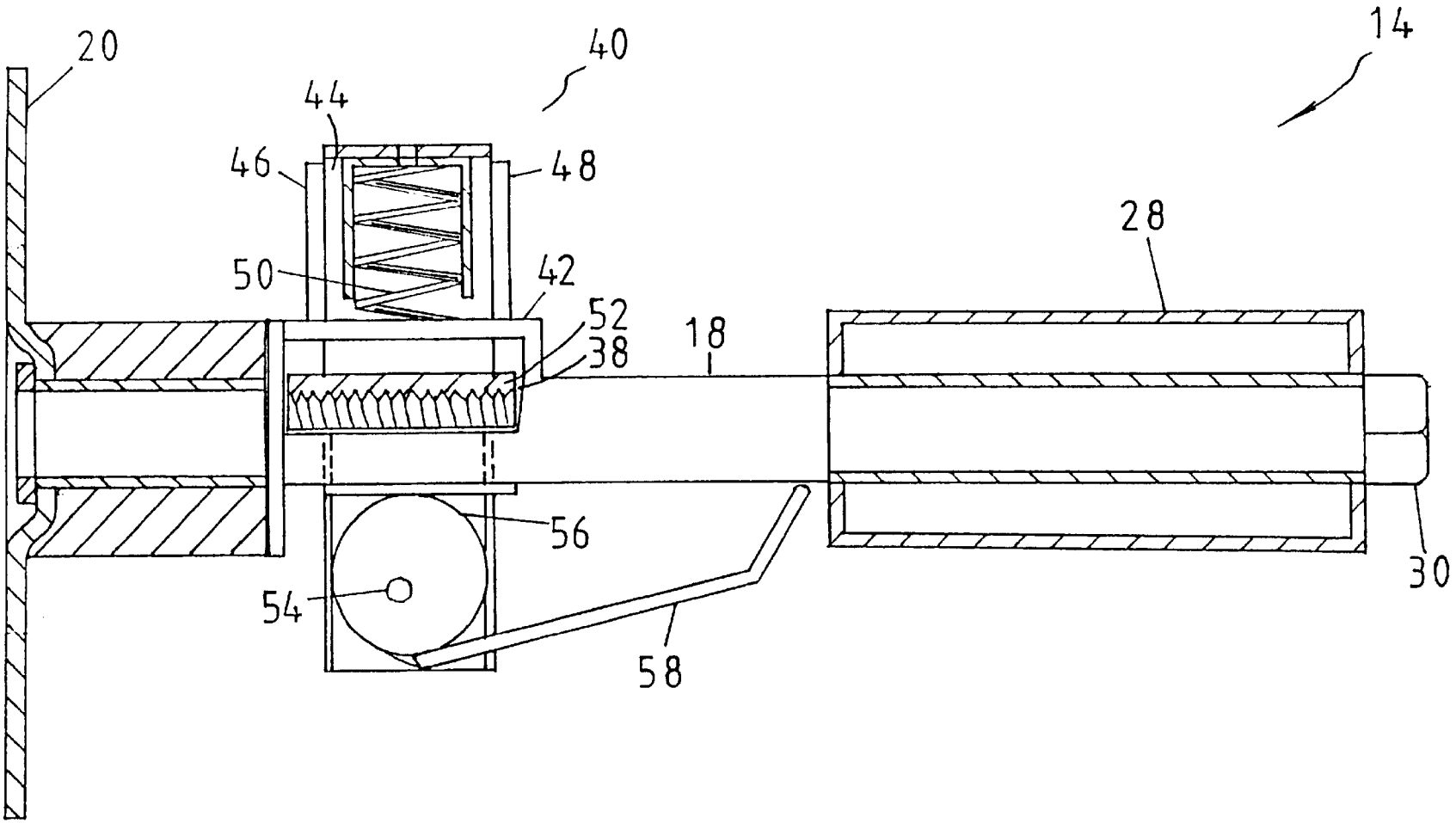
FIG. 3 is a cross-sectional view of the first clamping/shaping member shown in FIG. 2 when the engagement means is an engaged position.
Figure 5:
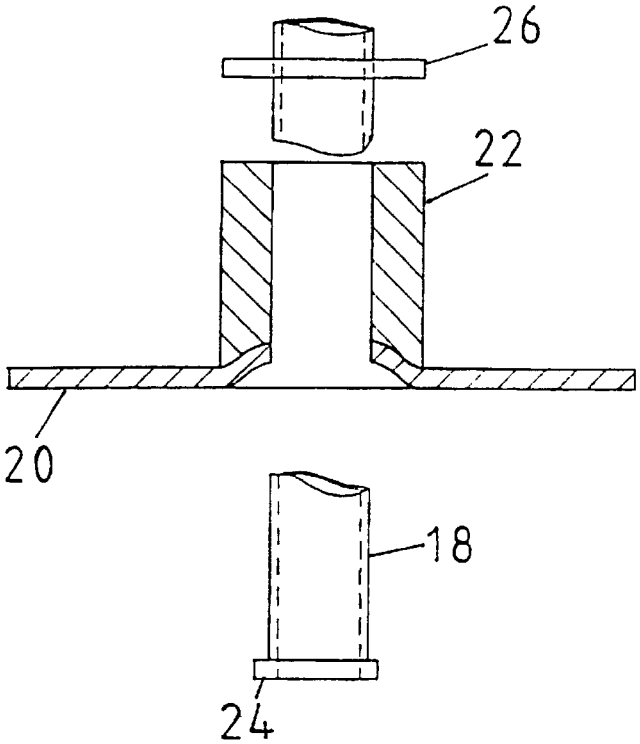
FIG. 5 is a cross-sectional view of the plate shown in FIG. 4.
Figure 4:
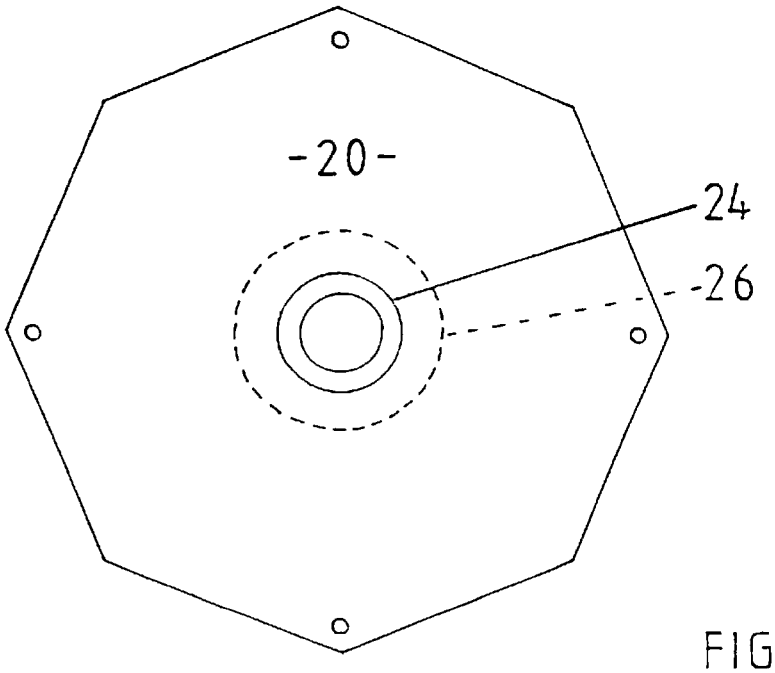
FIG. 4 is a front view of the clamping/shaping plate of the first member shown in FIG. 2.
Figure 7:
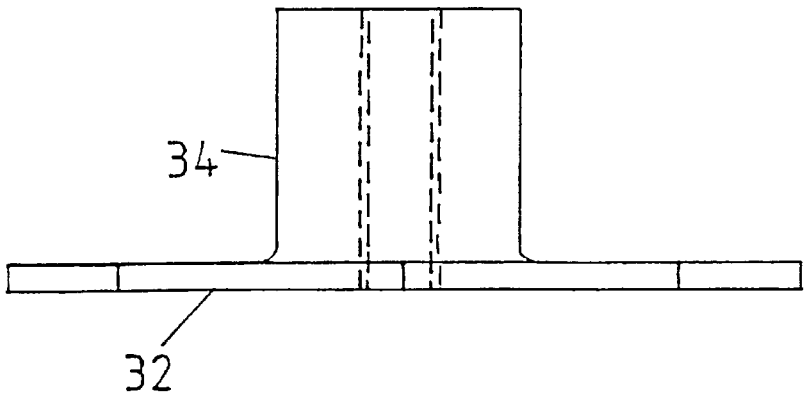
FIG. 7 is a cross-sectional view of the second member shown in FIG. 6.
Figure 6:
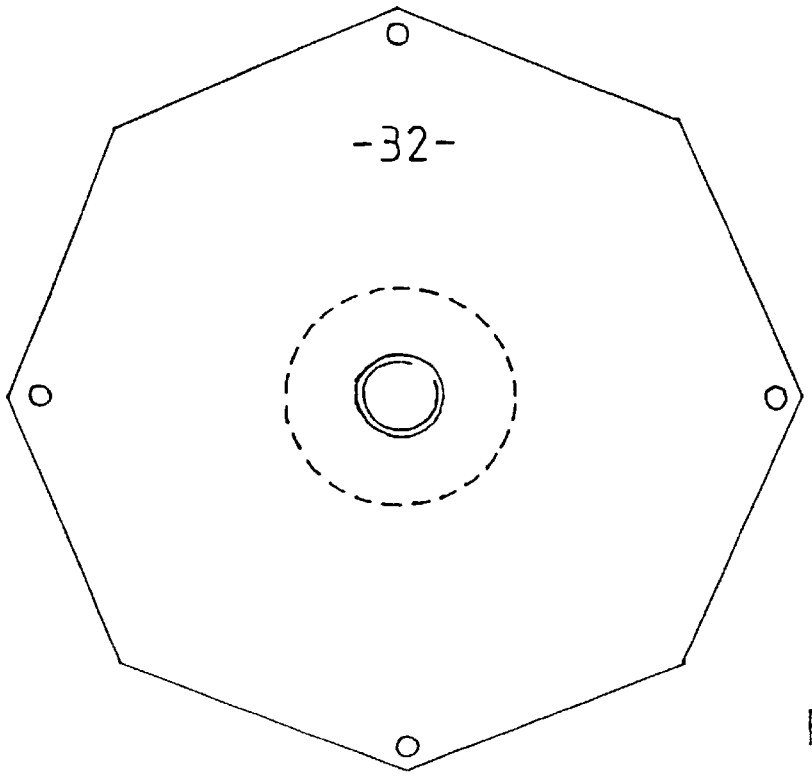
FIG. 6 is a front view of the second clamping/shaping plate of the second clamping/shaping member shown in FIG. 1.
Figure 8:
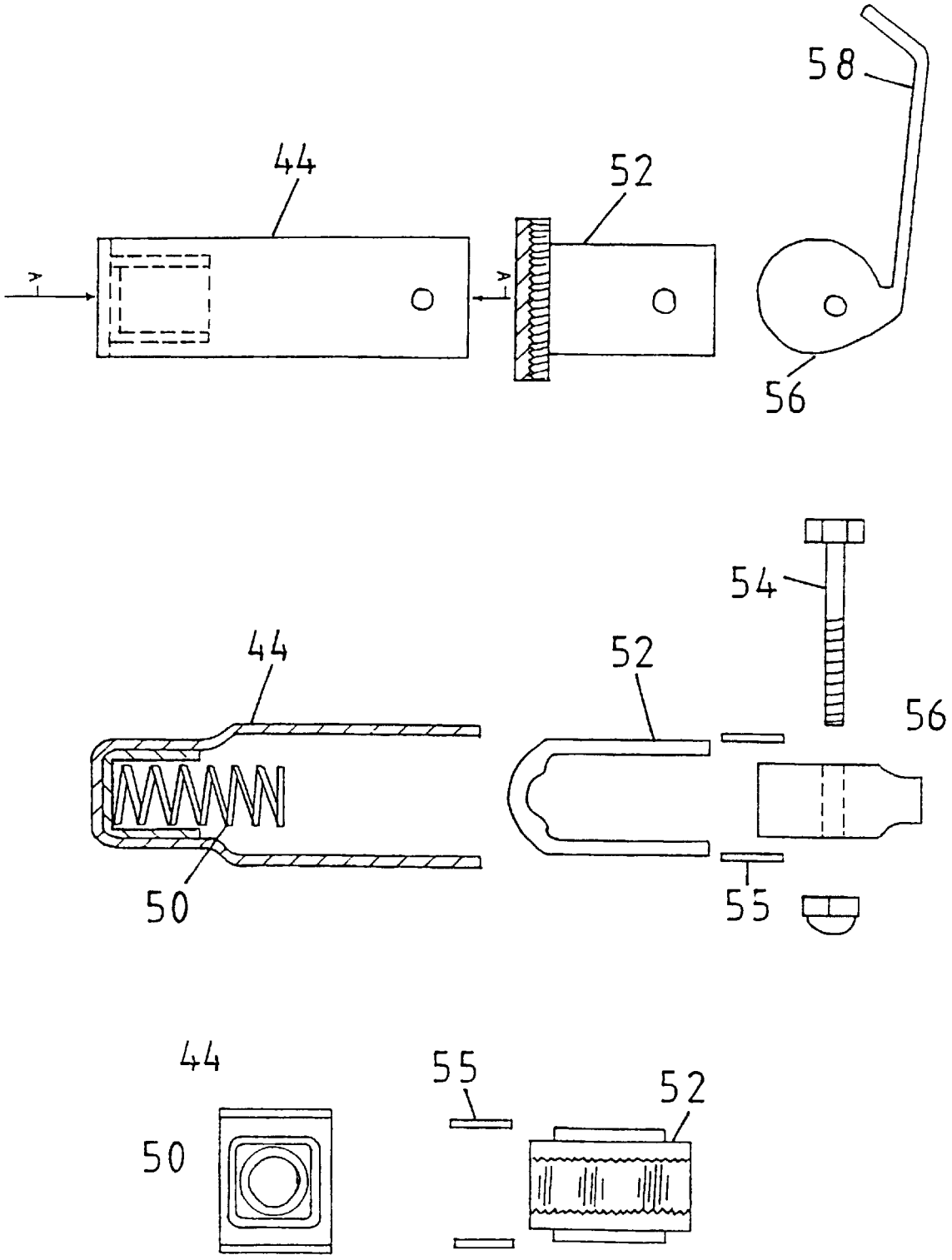
FIG. 8 is a exploded view of the engagement means of the first member shown in FIGS. 2 and 3.

Referring to FIGS. 2, 3 and 8 the engagement means 40 has an L-shaped plate 42 which is fixed in position over an aperture 38 in the tubular member 18, a U-shaped member 44 guided for movement between two spaced plates 46, 48 and housing a compression spring 50, and a toothed section 42 positioned for moving to an engaged position (see FIG. 3) through the aperture 38 or to a released position (see FIG. 2). The toothed section 52 is connected to the U-shaped member 44 by a bolt 54. A cam member 56 is located between arms of the U-shaped member 44. The cam member 56 is fixed to a lever 58 which facilitates rotational movement of the cam member 56.

When the lever 58 is rotated to the position as shown in FIG. 2 the tooth section 52 is in the released position in which the tubular member 18 can slide along the rod 12.

By rotating the lever 58 towards the tubular member 18, the U-shaped member 44 and the threaded tooth section 52 move towards the rod 12. When the lever 58 is at the position shown in FIG. 3 the tooth section 52 is in meshing engagement with the threaded rod 12. In this position the member 14 cannot slide along the rod 12. The cam member 56 maintains the U-shaped member 44 and the section 52 in the engaged position.

A compression spring 60 is used to bias the section 52 in the engaged position.

The tubular member 18 can however be rotated for advancing or retreating the member 14. This is used to adjust tension on the work piece.

Figure 9:
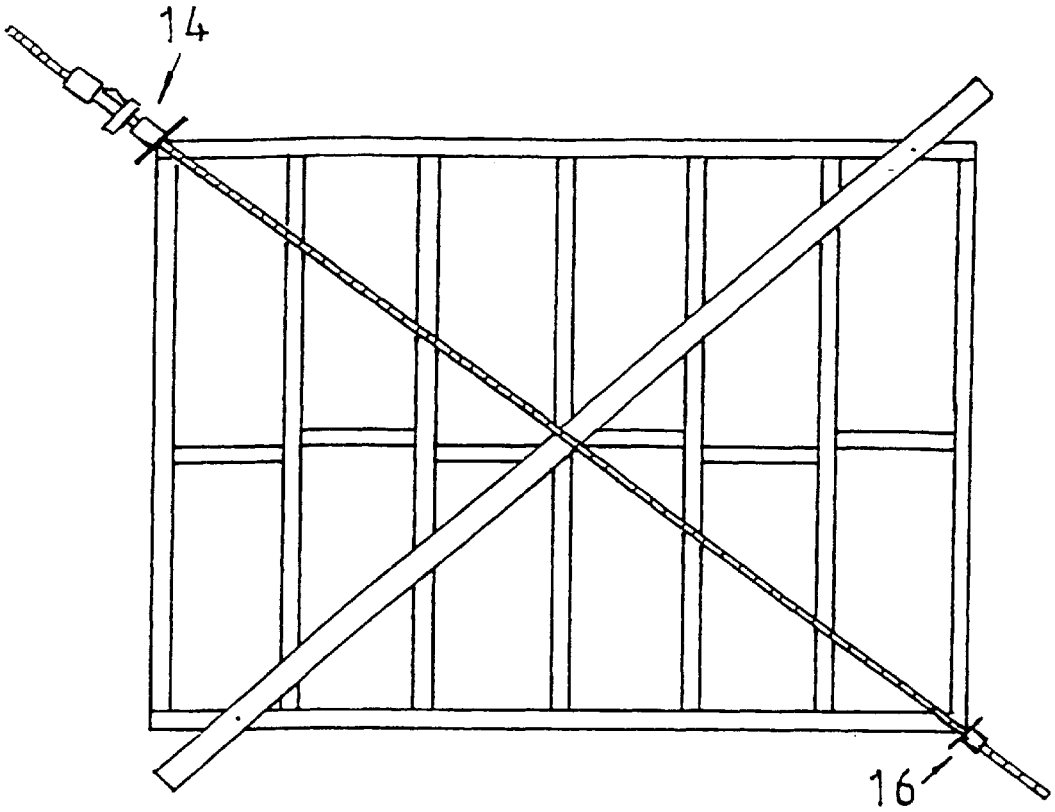
FIG. 9 shows the device shown in FIG. 1 being applied for squaring a building wall frame.

In FIG. 9, the device 10 is applied to square a building wall frame. In this regard the clamping/shaping members 14 and 16 are positioned at opposite corners of the wall frame and tension is applied to the corners by rotating the member 14 until the frame is square.

Figure 10:
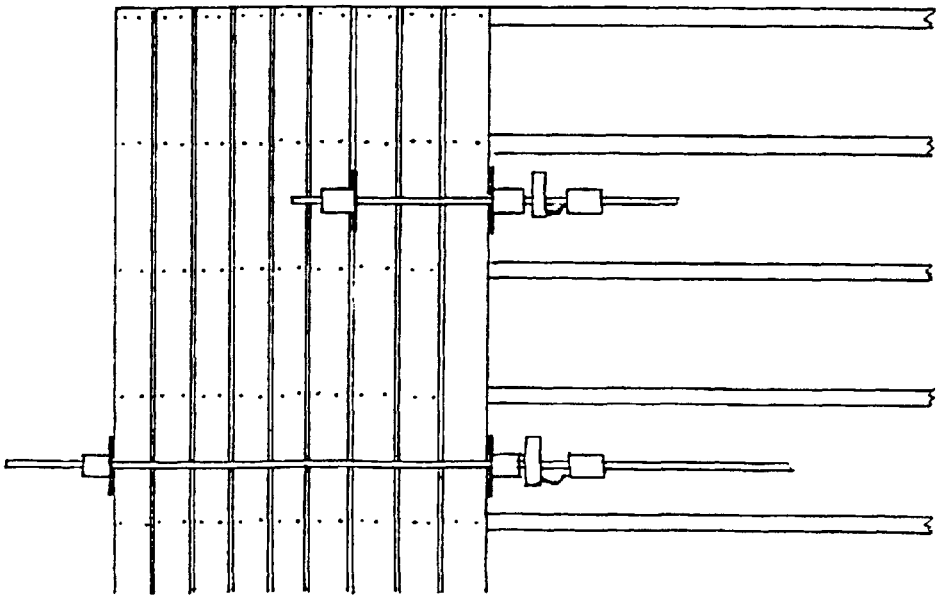
FIG. 10 shows an application of the device shown in FIG. 1 for clamping floor boards.

In FIG. 10, two devices 10 of the present invention are used to clamp floor boards of a decking.

Figure 11:
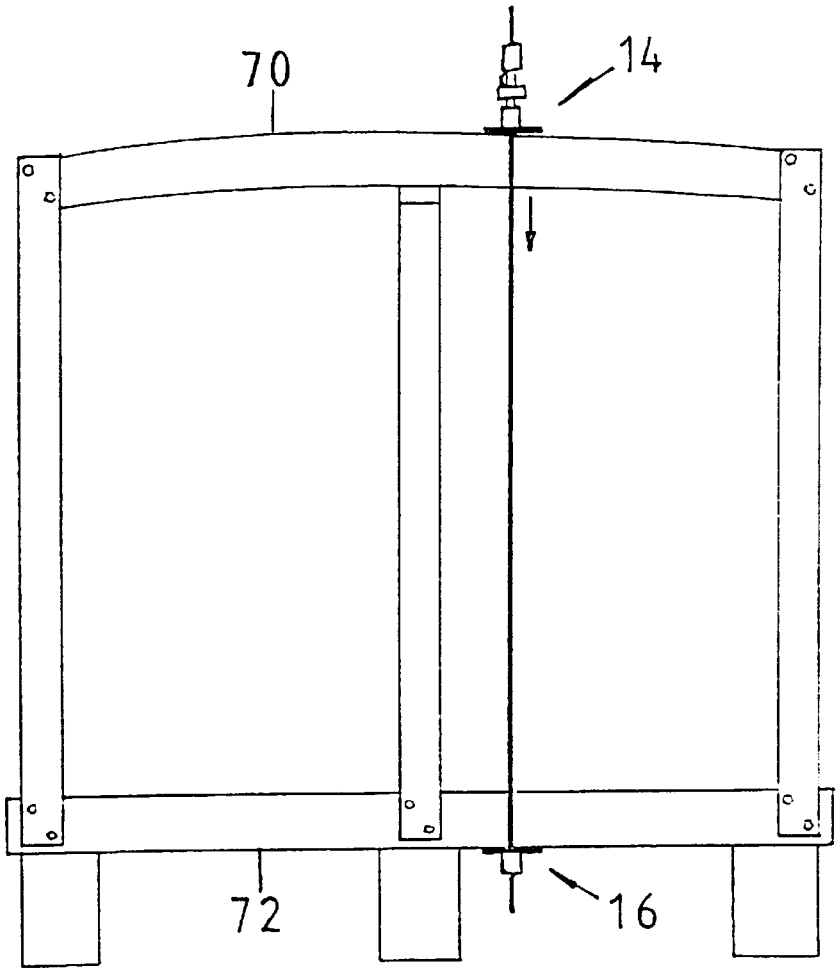
FIG. 11 shows an application of the device shown in FIG. 1 for straightening a bowed roof support beam.

FIG. 11 shows a roof support structure which has a slightly bowed beam 70. To straighten the beam 70 the device 10 of the present invention is positioned so that its clamping/shaping member 14 is in contact with the bowed beam 70 and its clamping/shaping member 16 is in contact with another beam 72. By rotating the member 14 toward the member 16 the bowed beam 70 can be straightened.

FIG. 12 shows the application of the device 10 in straightening a bowed floor joist.

In FIG. 13 there are shown different adaptations of the device for use as a clamp or vice on a work bench.

Whilst the above have been given by way of illustrative examples of the present invention many variations and modifications thereto will be apparent to those skilled in the art without departing from the broad ambit and scope of the invention as herein set forth.

What is claimed is:

1. A device for clamping one or more work pieces, the device comprising:

a plurality of threaded elongate members of different lengths, each elongate member having opposite ends;

a first clamping member and a second clamping member, both of said first and second clamping members being removably locatable on any of a selected one of the plural elongate members to form a clamping zone between said first and second clamping members; and a clamping plate attached to each of the first and second clamping members and arranged for clamping one or more work pieces between the clamping plates within a clamping zone, the first clamping member and the second clamping member being movably arranged so that a relative position between the first and second clamping members is continuously variable, the first clamping member including a thread engagement means movable between an engaged position for cooperatively engaging the selected one of the plural elongate members and a released position for releasing from engagement with said selected elongate member, wherein, in use, at said released position the first clamping member is slidable along the selected elongate member for positioning the first clamping member towards or away from the one or more work pieces, and at said engaged position the engagement means is rotatable for continuously varying the position of the clamping plate of the first clamping member relative to the clamping plate of the second clamping member.

2. The device according to claim 1 wherein at least the clamping plate of the first clamping member is arranged to remain rotationally stationary when in contact with the one or more work pieces and when the engagement means is rotated.

3. The device according to claim 2 wherein the first member includes a hollow tube through the hollow of which the elongate member extends, and the hollow tube having an aperture in a side wall, through which aperture the engagement means can move between the engaged position and the released position.

4. The device according to claim 3 wherein the plate of the first member is fixed to a sleeve, which sleeve is rotatably arranged at one end of the hollow tube, wherein the hollow tube is rotatable independently of the clamping plate of the first clamping member.

5. The device according to claim 3 wherein the engagement means has a toothed section which is in meshing engagement with the elongate member at said engaged position.

6. The device according to claim 1 wherein the first member includes biasing means arranged for biasing the engagement means to the engaged position or to the released position.

7. The device according to claim 1 wherein the first member includes position maintaining means for maintaining the engagement means in the engaged position.

8. The device according to claim 7 wherein the position maintaining means is in the form of a lock nut and bolt arrangement.

9. The device according to claim 1 wherein the second member is arranged for rotational movement about the elongate member.

10. The device according to claim 7, wherein the position maintaining means comprises a cam member.

11. A device for clamping a work piece, the device comprising:

a threaded elongate member;

a first clamping member and a second clamping member, each of said first and second clamping members being removably located on the elongate member to form a clamping zone between the first and second clamping members; and a clamping plate attached to each of the first and second clamping members and arranged for clamping a work piece between the clamping plates within a clamping zone, the first clamping member and the second clamping member being movably arranged so that a relative position between the first and second clamping members is continuously variable, the first clamping member including an engagable thread movable between an engaged position cooperatively engaging the elongate member and a released position releasing the engagable thread from engagement with the elongate member, wherein, in use, at the released position the first clamping member is slidable along the elongate member for positioning the first clamping member towards or away from the work piece, and at the engaged position the engagement means is rotatable for continuously varying the position of the clamping plate of the first clamping member relative to the clamping plate of the second clamping member, the clamping plate of the first clamping member is arranged to remain rotationally stationary when in contact with the one or more work pieces and when the engagement means is rotated, the first clamping member includes a hollow tube through the hollow of which the elongate member extends, and the hollow tube having an aperture in a side wall, through which aperture the engagement means can move between the engaged position and the released position, and the plate of the first clamping member is fixed to a sleeve, which sleeve is rotatably arranged at one end of the hollow tube, and the hollow tube is rotatable independently of the clamping plate of the first clamping member.

* * * * *